United States Patent [19]

Forney

[11] 4,243,851

[45] Jan. 6, 1981

[54] EAR CUSHIONING DEVICE FOR HEADPHONES

[76] Inventor: Robert B. Forney, Star Rte. 607, Muir Beach, Calif. 94965

[21] Appl. No.: 57,742

[22] Filed: Jul. 16, 1979

[51] Int. Cl.[3] ..... H04R 1/02

[52] U.S. Cl. ..... 179/156 R; 2/423; 2/DIG. 11; 179/184

[58] Field of Search ..... 179/156 R, 182 A, 182 R, 179/1 ST, 184; 181/137, 129; 2/423, 422, 209, DIG. 11

[56] References Cited

U.S. PATENT DOCUMENTS

| | | | |
|---|---|---|---|
| 3,789,164 | 1/1974 | Ryder | 179/156 R |
| 3,792,754 | 2/1974 | Hanson | 179/156 R X |

FOREIGN PATENT DOCUMENTS

| | | | |
|---|---|---|---|
| 638920 | 6/1950 | United Kingdom | 179/156 R |

OTHER PUBLICATIONS

"Listening Device," A. C. Holt, *IBM Technical Disclosure Bulletin* vol. 5, No. 10, Mar. 1963, p. 37.

*Primary Examiner*—Thomas W. Brown

*Attorney, Agent, or Firm*—Owen, Wickersham & Erickson

[57] ABSTRACT

An ear cushioning device is disclosed for use with plug type earphones mounted on a springable carrier, as are commonly dispensed on commercial airplanes. The cushioning device is of a soft, resilient foam material which provides comfort through a spreading of the pressure from the earphones over the entire ear of the user. A preferred embodiment of the device is formed integrally from a single foam pad, with the ear cushions at the ends and a stretchable band between the cushions, for extension over the top of the user's head. The stretchable band is preferably a convoluted formation which acts as a light spring, tending to pull the ear cushions toward one another. Openings through the ear cushions receive the plug type earphones, so that the latter do not extend into the user's ears. In another embodiment, a semi-rigid head band fits over the head with a pair of soft foam ear cushions slidably mounted on the ends of the head band. An elongated opening at each end of the head band receives an earphone plug for transmission of sound to the ear, and the head band and cushions accept and spread the pressure of the earphones. In either embodiment, soft pliable inserts may be positioned in the ear cushion openings to receive the earphone plugs and carry the sound into the ears.

6 Claims, 6 Drawing Figures

EAR CUSHIONING DEVICE FOR HEADPHONES

BACKGROUND OF THE INVENTION

The invention relates to audio equipment, and more particularly to a novel ear cushioning device for use with plug type headphones.

Plug type earphones such as are commonly used on commercial airlines are generally quite uncomfortable to the ears. They usually include a U-shaped plastic band which urges the ear plugs against the ears, with the plastic band extending downwardly, below the chin. Although rubbery shields are typically provided at each earphone for engaging against and within the ears, the earphones remain quite uncomfortable because of the way they must be pushed into the ears to remain in place and to conduct the sound properly.

The type headset-mounted earphones generally used in airplanes are the type that convey sound through a conduit, with plastic tubes leading to each earphone. However, the above discussion applies equally to electronic plug type earphones mounted on a headset. Before the present invention, no simple but effective solution had been found to the problem of the discomfort associated with plug type earphones of either type.

SUMMARY OF THE INVENTION

The cushioning device of the present invention is simple, inexpensive, easy to use and reliable in eliminating the discomfort of headset-mounted earphones, without detracting from the earphones acoustically. The device, which preferably comprises a unitary, integrally formed soft foam pad, is positioned on the user's head with ear cushions over the user's ears. The earphone plugs are received in openings preferably extending through the ear cushion, so that they are spaced somewhat from the ears, not extending into the ears as has previously been the case. A series of convolutions formed in the foam material between the two ear cushions provides a stretchable band which acts as a light spring tending to pull the two ear cushions together, and thus affords adjustability and helps support the ear cushions at the desired position on the ears when the device is being used.

The soft foam material of which the ear cushioning device is integrally formed provides several functions: cushioning of the ear for comfort, by eliminating sharp contact and spreading the inward force of the earphones over a much larger area, avoiding pressure on the inner ear, without detracting from the quality of the sound; and provision of a lightly springable, fully adjustable supporting band. Also, the ear cushions eliminate a hygene problem by avoiding insertion of the ear plugs into the outer ear, providing still another advantage.

The earphone plugs of the headset are pushed into the openings of the ear cushions, preferably until the plug extends through the cushion, so that it will be closely adjacent to the ear for best sound transmittal. However, the ear cushion may alternatively include, in either embodiment, soft pliable inserts positioned in and through the openings, extending into the outer ear, for receiving the earphone plugs and transmitting the sound into the ears. Pressure from the spring-biased earphone plugs still is absorbed by the cushions and spread over the entire ear, assuring comfort.

Accordingly, in one embodiment of the invention, an ear cushioning device for use with headset-mounted plug type earphones comprises a one-piece integrally formed pad of soft, resilient foam material having two ear cushions, one at each end, for placement against the ears; each ear cushion having an earphone-receiving opening located generally centrally, to be positioned over the ear opening of the user; and said pad including a stretchable band connecting the two ear cushions, for extending over the top of the user's head and for helping support the ear cushions in place against the ears, whereby the user may position the ear cushioning device over the head, with the two cushions against the ears, and with the earphone headset received with the plug type earphones springingly engaged within the openings.

In a second embodiment an ear cushioning device according to the invention is comprised of three assembled components: a semi-rigid headband for positioning over the top of the user's head, and a pair of preferably round ear cushions having generally diametral slots for sliding engagement over the two ends of the headband, so that the position of the ear cushions on the headband is fully adjustable to accommodate different head sizes. The headband has an elongated slotted opening near each end, to register with a recess or bore centrally positioned in the ear cushion, so that the sound from the ear plug is transmitted through the slot, regardless of the adjusted position of the cushion.

Therefore, it is among the objects of the inveniton to provide an ear cushioning device adapted for use with headset-mounted plug type earphones, of simple and inexpensive construction and having the capabilities of full adjstment, fixed, reliable support on the user's head without tight clamps, comfort to the user's ears and elimination of hygiene problems. These and other objects, advantages and features of the invention will be apparent from the following description of the preferred embodiments, taken in conjunction with the accompanying drawings.

DESCRIPTION OF THE PREFERRED EMBODIMENTS

Figure 1:
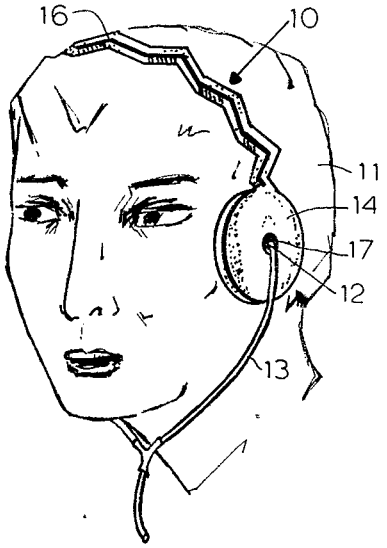
FIG. 1 is a perspective view showing an ear cushioning device according to the invention positioned on a user's head and used in conjunction with a pair of headset-mounted plug type earphones.

In the drawings, FIG. 1 shows an ear cushioning device 10 according to the invention positioned on the head 11 of a user, with plug type earphones 12 engaged in the device 10 at each ear, the earphones 12 being part of a headset 13. As noted above, the headset 13 is usually of the type dispensed on commercial airlines, with the plug type earphones 12 biased toward one another for engaging against the user's outer ear, as these headsets have been used previously. The earphones 12 may be of the type that directly transmit air-carried sound through tubes, or they may be electronic earphones.

Figure 2:
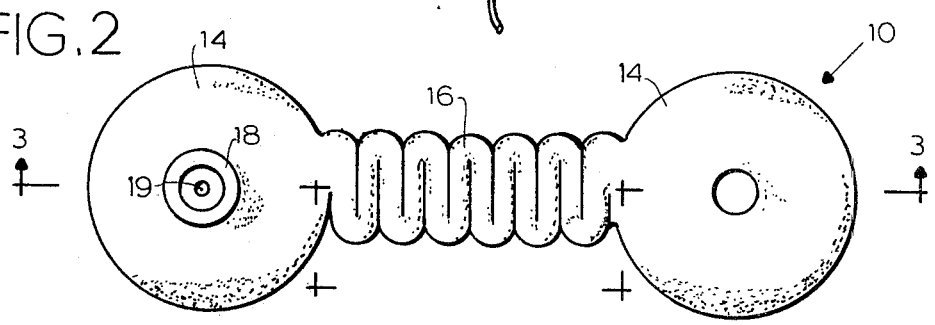
FIG. 2 is the plan view of the ear cushioning device, shown in the flattened and drawn together configuration in which it is originally formed, and showing on one side a pliable insert that may be included, extending through the cushion's opening for transmitting sound to the ear.

The ear cushioning device 10 is shown in a contracted, flat storage position in FIG. 2. It is integrally formed from a soft, resilient foam material such as polyether, polypropylene, or polyester urethane foam. It is formed, preferably by cutting, in the position shown in FIGS. 2 and 3. It comprises an integral pad having a pair of ear cushions 14 at its ends, joined by a convoluted stretchable band 16. The convoluted band 16 of course tends to pull together toward the position shown in FIG. 2, and it exerts a light springing force when the ear cushions are pulled apart from one another. Thus, as shown in FIG. 1, the stretchable band 16 pulls upwardly lightly on the ear cushions 14 when the device is positioned on the user's head, helping to support the cushions 14 and the earphones 12 in position against the user's ears. The frictional engagement of the soft foam material against the ears and the upper part of the head also helps support the device in this position, particularly when aided by the inward biasing force of the headphone apparatus 13.

As indicated in the drawing, each ear cushion 14 includes an opening or bore 17 for receiving the ear plugs 12. A mere recess in the ear cushion would be sufficient to receive and hold the ear plugs, but a through bore 17 is preferred because it transmits sound better, and also it is generally more easily formed than a recess.

Figure 4:
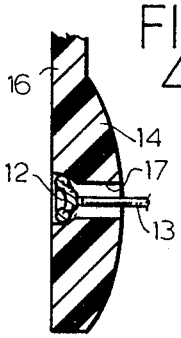
FIG. 4 is a sectional view of an ear cushion of the device with a plug type earphone of a headset positioned in the cushion's opening.

FIG. 4 shows the manner in which the earphone plug 12 preferably is positioned in the ear cushion 14. It is forced into the bore 17 from the outside and pushed to the opposite side of the bore, so that it is closely adjacent to the user's ear when in use. The plug 12 may be positioned to extend slightly out of the bore 17 and into the outer ear, if desired. The foam material of which the device 10 is made is soft and pliable enough to permit easy insertion of the ear plug 12 in the somewhat-undersized bore 17, while still gripping the plug securely.

As discussed previously, the ear cushioning device according to this embodiment of the invention utilizes the soft, resilient foam material from which it is made to provide several important features: comfort to the ears and the head, full adjustability for different users, support of the cushions and the earphones in the desired position, through a springable, integrally formed band and through the inherent friction of the material, and the spacing of the plug type earphones away from the ears to avoid pressure on the ears. Thus, the unitary ear cushioning device 10 provides a number of unexpected advantages, principally through the use of a resilient foam material in forming the device.

Figure 3:
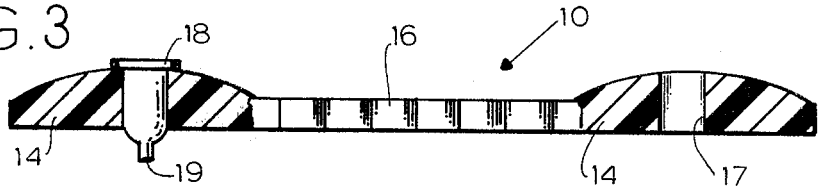
FIG. 3 is a sectional elevational view of the device, taken along the line 3—3 of FIG. 2, and also illustrating the insert at one side.

FIGS. 2 and 3 show an optional insert 18 which may be installed in the openings 17, shown on only one ear cushion in these views for illustration. The insert 18 is of a soft, pliable rubbery material and is sized to fit snugly in the opening of the ear cushions 14 and to extend from the exterior through the cushion to protrude out the other side somewhat, as shown in FIG. 3. This positions the narrow inner end in the ear of the user, and a hole 19 is provided for transmitting sound into the ear. The purpose of the insert 18 is to conduct the sound from the earphone plug 12, which is inserted therein (e.g. see FIG. 5), farther into the ear should this be necessary for adequate volume. The inserts 18 may be adjusted in or out for maximum comfort and the desired sound characteristic. If the inserts 18 are to be used, the ear cushion openings 17 preferably are slightly larger in diameter.

Figure 5:
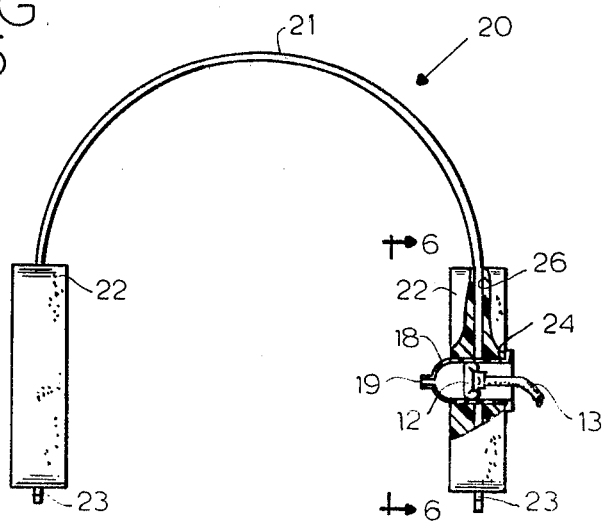
FIG. 5 is an elevational view of a second form of ear cushioning device according to the invention.
Figure 6:
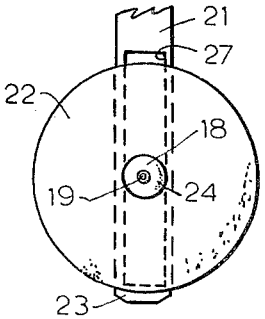
FIG. 6 is a view showing one of the ear cushions of the device of FIG. 5, taken along the line 6—6 of FIG. 5, with a pliable insert installed in one ear cushion and an earphone plug engaged therein.

FIGS. 5 and 6 show an alternate form of the invention. An ear cushioning device 20 according to this embodiment of the invention comprises a relatively rigid head band 21 with a pair of ear cushions 22 slidably positioned on its ends 23. Each ear cushion 23 comprises a resilient foam pad having a central bore 24, as in the first embodiment. As indicated in FIG. 5, the ear cushions 22 also include a generally diametral slotted opening 26 to accommodate the head band 21. In order that the plug type earphones be permitted to extend to adjacent the ear, the head band 21 includes an elongated slot or opening 27, as shown in FIG. 6. The position of the ear cushion 22 on the head band is thus fully adjustable to accommodate different users. The head band 21 lightly urges the ear cushions 22 inwardly against the ears when the device is positioned on the user, and this force, as well as the inwardly-acting force of the earphone headset, is spread over the user's ear so that any discomfort is avoided.

FIGS. 5 and 6 also show the optional use of the soft sound-transmitting inserts 18 with this embodiment of the invention, with an earphone plug 18 illustrated engaged within the insert. Of course the ear cushioning device 20 of this embodiment may be used without inserts 18, with the plugs 12 inserted similarly to as shown in FIG. 4.

The above described preferred embodiments provide ear cushioning devices for use with otherwise uncomfortable plug type earphones. The cushioning devices are simple and inexpensively produced, yet highly effective in providing comfort to the user. Various other embodiments and variations to these preferred embodiments will be apparent to those skilled in the art and may be made without departing from the spirit and scope of the following claims.

I claim:

1. An ear cushioning device for use with headset-mounted plug type earphones, comprising:

a one-piece integrally formed pad of soft, resilient foam material having two ear cushions, one at each end, for placement against the ears;

each ear cushion having an earphone-receiving opening located generally centrally, to be positioned over the ear opening of the user; and said pad including a stretchable band connecting the two ear cushions, for extending over the top of the user's head and for helping support the ear cushions in place against the ears;

whereby the user may position the ear cushioning device over the head, with the two cushions against the ears, with the earphone headset to be received with the plug type earphones springingly engaged within the openings.

2. The device of claim 1 wherein the stretchable band comprises a series of convolutions formed in the resilient foam material, the convolutions being formed to tend toward a normal pulled-together configuration.

3. The device of claim 1 wherein the earphone-receiving openings pass through the ear cushions and are sized slightly smaller in diameter than the earphone plugs, so that the plugs are received snugly in the openings.

4. The device of claim 1, further including a soft pliable insert in each earphone-receiving opening, having a hollow interior and extending out the inner side of the ear cushion for protruding into the ear, for receiving a plug earphone and conducting sound into the ear.

5. An ear cushioning device for use with headset-mounted plug type earphones, comprising:

a semi-rigid, springably yieldable generally U-shaped head band, having an elongated slotted opening near each end;

a pair of ear cushions formed of a soft, resilient foam material for placement against the ears, each ear cushion being generally round in shape and having a generally diametral slot through which an end of the head band passes and is received in frictional engagement whereby the ear cushions are adjustable as to position on the head band and thus as to user size; and each ear cushion also having an earphone-receiving opening positioned generally centrally and aligned with the elongated slotted opening of the head band;

whereby the ear cushioning device may be positioned on the user's head with the head band over the top of the head and the ear cushions adjusted to engage resiliently against the ears, with an earphone headset to be received with its earphone plugs springingly engaged within the earphone-receiving openings.

6. The device of claim 5, further including a soft pliable insert in each corresponding earphone-receiving opening, having a hollow interior and extending out the inner side of the ear cushion for protruding into the ear, for receiving a plug earphone and conducting sound into the ear.

* * * * *